US011060334B2

(12) United States Patent
Augustin et al.

(10) Patent No.: US 11,060,334 B2
(45) Date of Patent: Jul. 13, 2021

(54) VERTICAL SLIDING ELEMENT

(71) Applicant: DOBLER METALLBAU GMBH, Deggendorf (DE)

(72) Inventors: Christian Augustin, Bischofsmais (DE); Jurgen Kain, Bernried (DE); Tanja Süß, Kirchdorf im Wald (DE)

(73) Assignee: METALL BAU GmbH, Deggendorf (DE)

( * ) Notice: Subject to any disclaimer, the term of this patent is extended or adjusted under 35 U.S.C. 154(b) by 176 days.

(21) Appl. No.: 16/166,651

(22) Filed: Oct. 22, 2018

(65) Prior Publication Data

US 2019/0128036 A1 May 2, 2019

(30) Foreign Application Priority Data

Nov. 2, 2017 (DE) ..... DE102017125576.1

(51) Int. Cl.
*E05D 15/20* (2006.01)
*E06B 3/44* (2006.01)
(Continued)

(52) U.S. Cl.
CPC ..... *E05D 15/20* (2013.01); *E05D 13/14* (2013.01); *E05D 15/165* (2013.01); *E05D 15/18* (2013.01);
(Continued)

(58) Field of Classification Search
CPC ..... E05D 15/1005; E05D 15/20; E05D 15/18; E06B 3/4407
See application file for complete search history.

(56) References Cited

U.S. PATENT DOCUMENTS 4,551,945 A * 11/1985 von Resch ..... E05D 15/1013 49/221
4,802,307 A * 2/1989 Schmidt ..... E05D 15/1015 49/219
(Continued)

FOREIGN PATENT DOCUMENTS

DE 2503802 8/1976
DE 272419 12/1978
(Continued)

OTHER PUBLICATIONS

EP Office Action.

*Primary Examiner* — Catherine A Kelly
(74) *Attorney, Agent, or Firm* — Welsh Flaxman & Gitler LLC

(57) ABSTRACT

The invention relates to a vertical sliding element including an element frame and a sash which can be moved in the vertical direction relative to the element frame. In the closed position of the sash, one fitting chamber each is formed in the intermediate spaces which are laterally limited by mutually facing side faces of the sash and the element frame. Each fitting chamber is provided with a guide rail and guide elements guided in the guide rail. The sash is connected to the guide elements via a scissors' arrangement having a plurality of parking scissors. The scissors arrangement is designed for parallel parking of the sash in a partially open position, in which the sash is positioned in front of an opening in the element frame, seen in the horizontal direction, and wherein the guide elements are designed to move the sash parked in parallel in the vertical direction by moving the guide elements in the guide rails.

14 Claims, 10 Drawing Sheets

(51) Int. Cl.

| | |
|---|---|
| ***E05D 15/16*** | (2006.01) |
| ***E06B 3/263*** | (2006.01) |
| ***E05D 15/18*** | (2006.01) |
| ***E05D 13/00*** | (2006.01) |

(52) U.S. Cl.
CPC ..... *E06B 3/26347* (2013.01); *E06B 3/44* (2013.01); *E06B 3/4407* (2013.01); *E05Y 2900/148* (2013.01); *E06B 2003/26321* (2013.01); *E06B 2003/26383* (2013.01); *E06B 2003/4453* (2013.01)

(56) References Cited

U.S. PATENT DOCUMENTS

| | | | | |
|---|---|---|---|---|
| 8,245,445 | B2 * | 8/2012 | Palacios | E05D 13/1253 49/127 |
| 10,533,364 | B2 * | 1/2020 | Wexler | E06B 9/00 |

FOREIGN PATENT DOCUMENTS

| | | | |
|---|---|---|---|
| DE | 2724149 | | 12/1978 |
| DE | 1020161050064 | A1 | 9/2017 |

* cited by examiner

VERTICAL SLIDING ELEMENT

BACKGROUND OF THE INVENTION

1. Field of the Invention

The invention relates to a vertical sliding element, a façade element with such a vertical sliding element, and a fitting for a vertical sliding element.

2. Description of the Related Art

Vertical sliding elements, in particular vertical sliding windows, are basically known. They comprise a sash which is vertically movable in relation to a façade element, e.g. a fixed façade element or another sash.

On the one hand, vertical sliding elements are known which, even in the closed position, have an offset transverse to the sliding direction with respect to the façade element, in relation to which they can be moved. As a result, the sliding movement of such a vertical sliding element can be carried out without a swing-out movement transverse to the sliding direction.

Furthermore, vertical sliding elements have become known which, in the closed position, are arranged substantially in alignment with the façade element, in relation to which they can be moved. Prior to the vertical sliding movement, the vertical sliding element is first arranged on the inner side in front of the fixed façade element by a swing-out movement and can then be moved vertically in relation to the façade element. The swing-out movement can be carried out by a lever or scissors mechanism or by a rail guide.

A problem with vertical sliding elements known from the prior art is that they are often difficult for users to operate and are also disadvantageous with regard to the appearance of the vertical sliding element since fittings frequently required for sliding remain visible on the inside even in the closed position.

SUMMARY OF THE INVENTION

An object of the invention is to provide a vertical sliding element that is highly user-friendly and allows visually improved integration of the fittings.

According to one aspect, the invention relates to a vertical sliding element, including an element frame and a sash that can be moved vertically in relation to the element frame. In the closed position of the sash, a fitting chamber is formed in each of the intermediate spaces laterally confined by mutually facing side faces of the sash and the element frame. Each of the fitting chambers is provided with a guide rail and guide elements guided in this guide rail. The sash is connected to the guide elements by a scissors' arrangement having a plurality of parking scissors. The scissors arrangement is designed for the parallel parking of the sash in a partially open position, in which the sash is positioned in front of an opening in the element frame (as seen in the horizontal direction). The guide elements are designed to move the parallel parked sash in a vertical direction by sliding the guide elements in the guide rails in order to move the sash from the partially open position to an open position, in which the opening in the element frame is uncovered.

A main advantage of the vertical sliding element, according to the invention, is that the guide rails, which are narrow units, can be integrated into the fitting chamber and can therefore be arranged in an optically inconspicuous way in the element frame. In addition, the use of guide elements guided in guide rails makes the vertical sliding element easy to operate.

According to one embodiment, the sash is connected to the guide rails via a pair of support bars. These support bars form supporting elements for the sash, by means of which the sash is movably held in the guide rails. These support bars are preferably aligned with their longitudinal axes parallel or substantially parallel to the longitudinal axes of the guide rails and remain in the area of the element frame when the sash is swung out in parallel.

Preferably, the length of the support bars is at least half of the height of the sash, in particular two thirds of the height of the sash. Preferably, at each support bar, a pair of parking scissors is provided. For example, the parking scissors provided at a support bar are identical in view of their form and function, specifically identically shaped.

Preferably, the parking scissors are hinged to the support bars. This makes it possible to park the sash away from the support bars.

According to one embodiment, the support bars are movably held in the guide rails by a plurality of guide elements. Preferably at least two, more preferably at least three, guide elements are provided on each support bar. The guide elements can in particular be sliding carriages made of a plastic material with self-lubricating properties. The guide elements can also be accommodated in form-fit fashion in the guide rails so that the guide elements can only be removed from the guide rail by sliding them out on the top or bottom.

According to one embodiment, at least two elongated holes are provided in each of the support bars. The elongated holes interact with the parking scissors and serve to affect the parallel parking of the sash. In particular, it is possible to open or close the parking scissors via the elongated holes by means of a translational movement that is carried out by an end of a scissors leg.

According to one embodiment, at least two parking scissors are provided on each of the vertical sash sides opposite one another. This scissors arrangement of at least four parking scissors allows a stable parallel guidance of the sash during the parallel parking movement. In other words, the sash always remains vertically or substantially vertically aligned with its vertical axis during the parallel parking movement from the closed position to the partially open position.

According to one embodiment, the parking scissors each have a long and a short scissors leg. The sash is attached on the free end side of the long scissors leg. The short scissors leg limits the pivoting path of the long scissors leg and thus limits the parallel parking of the sash.

According to one embodiment, the first free end of the short scissors leg is hinged to the long scissors leg and the second free end is hinged and movably connected to the guide rail. This allows the parallel parking of the sash to be limited by the short scissors leg.

Preferably, the long and short scissors legs are aligned in parallel or substantially in parallel in the closed position of the sash. In a (partially) open position, the short scissors leg is inclined at an acute angle to a vertical or to the support bar, the angle opening downwards. In a (partially) open position, the long scissors leg, on the other hand, also runs obliquely to the vertical or to the support bar, the angle opening upwards. As a result, the sash moves from the closed position to the partially open position due to its own weight, i.e. parallel parking is achieved without a force exerted by a user due to the weight of the sash itself.

According to one embodiment, a free end of the short scissors leg is guided at least indirectly in a movable fashion on the support bar. This guidance can be carried out either directly by connecting a free scissors leg to an elongated hole or indirectly via an intermediate coupling element, for example a guide element carrier.

According to one embodiment, the free end of the short scissors leg is connected to the support bar via a guide element carrier, in particular a sliding carriage carrier. The guide element carrier is guided movably on the support bar. In other words, the guide element carrier is guided movably, for example in an elongated hole, on the support bar. The short scissors leg can here be pivotally connected to the guide element carrier. This allows the elongated hole required for the parallel parking of the sash to be provided further up on the support bar. Thus, a larger recess in the support bar can be achieved, into which, in the closed position of the sash, a free end of the long scissors leg can then swing in.

According to one embodiment, locking members provided on the sash side cooperate with locking members provided on the support bars. The sash is preferably provided with movable locking bolts which can be moved via a locking mechanism. When the sash is locked, they cooperate with locking blocks provided on the support bars. Space-saving locking can be achieved by providing the support bars with the locking members on the side of the element frame since the plane in which the locking bolts or locking blocks are provided can coincide with the plane in which the support rails or the guide rails are provided. As a result, the construction depth of the fitting chamber can be significantly reduced.

According to one embodiment, the sash has laterally projecting cover sections, by means of which the fitting chambers are at least partially concealed. These cover sections are in particular provided on the inside of the sash. The cover sections can be provided in particular circumferentially along the sash. Preferably, the cover sections are dimensioned in such a way that a shadow groove is formed between the free end of the cover section and the element frame. For example, this shadow groove can have a width of 2 mm to 6 mm, preferably 4 mm.

According to one embodiment, a weight compensation is provided for the vertically movable sash. This ensures that the sash does not move unintentionally too quickly into the open position when it is opened. Furthermore, the closing process can be considerably facilitated by the weight compensation since the sash only has to be lifted with little force. The weight compensation is preferably adapted to the weight of the sash in such a way that the sash can be positioned in any opening position without the sash moving into the fully open position due to gravity.

According to one embodiment, the weight is compensated for by means of a counterweight which is coupled to the movable sash via a connecting member (e.g. a rope) which is guided via a deflection roller. The counterweight is here selected in such a way that it almost completely compensates the weight of the sash, so that only minor forces have to be exerted to move the sash into the open or closed position. If necessary, a plurality of deflection rollers can also be provided to suitably deflect the connecting member.

The counterweight can be provided in particular in a profile section of the element frame. For example, it can be movably guided on a slide rail via slide guides.

According to one embodiment, a counterweight that balances the weight is connected to the support bars provided on opposite sides of the sash by connecting members. Preferably, a pair of ropes is used as a connecting member, the ropes each establishing a connection between one of the support bars and the counterweight. The connecting members can here be suitably deflected via deflection rollers.

According to one embodiment, the sash in the closed position is arranged in flush-mounted or essentially flush-mounted fashion on the outside in the element frame. "Flush-mounted" here means in particular that the sash frame or the outer surface of the sash (in the case of a full sash without infill or glass) lies in one plane or essentially in one plane with the outer surface of the element frame. However, partial areas of the vertical sliding element provided on the element frame, for example glass strips, etc., can also protrude from this plane.

According to one embodiment, the sash is flush-mounted or essentially flush-mounted with the element frame in an open position or also in a partially open position, i.e. after parallel parking, on the inside. In other words, the sash or sash frame and the inside of the element frame facing the interior lie in a common plane or essentially in a common plane. This allows the sash to be opened in a space-saving way.

Preferably, the element frame has a depth greater than twice the sash depth. This allows the sash to be moved from a closed position, in which the sash is flush-mounted on the outside, to an open position, in which the sash is flush-mounted on the inside.

According to one embodiment, the element frame has a section (hereinafter referred to as element frame section) which extends in the direction of a building interior and has profile chambers and the side face of which that faces the sash is provided with the guide rail. For example, the section of the element frame that includes the profile chambers can be lower than the sash so as to create between a pair of such element frame sections an area in which the sash can be received in the open position. Preferably this is accomplished in such a way that this sash does not protrude from element frame sections on the inside. This allows the guide rail to be integrated in an optically inconspicuous fashion into the element frame.

According to one embodiment, the guide rail is provided on one side face of a vertically extending section of the element frame that is designed as a profile rail. The profile rail can be formed in particular by an aluminum composite profile comprising a thermal separation. The profile section project inwards from the thermal separation having a profile depth such that the guide rail can be integrated. For example, the profile depth can be selected to be greater than 100 mm. This makes it possible to integrate the guide rails on the side faces facing the sash, even in the case of swing-out movements with a large stroke (for example in the range from 50 mm to 100 mm).

According to one embodiment, the sash is formed by a composite profile without glass or infill element. In other words, the sash is formed by a composite profile piece which does not form a frame for receiving the glass or infill element, but the composite profile piece has a width such that it closes the opening formed in the element frame over its entire surface in the closed position. The composite profile piece preferably has one or more chambers, which can be filled in part with thermally insulating material. As a result, in particular small openings, such as ventilation openings, can be closed by the sash.

According to one embodiment, a sensor system is provided for monitoring a locking state. This sensor system can be designed in particular for the evaluation of a magnetic field by a sensor. In particular, it can comprise a first and a second sensor system part, wherein the distance of these sensor system parts relative to one another can be changed during the locking process. In particular, the distance between the sensor system parts in the locked state can be smaller than in the unlocked state, so that, for example, locking information is not output at the sensor until the sash has been locked in the element frame. This allows central monitoring of the locking status of a plurality of sashes.

According to a further aspect, the invention relates to a façade element comprising a façade element frame having a panel element provided in the façade element frame and a vertical sliding element according to one of the above described embodiments. The vertical sliding element is here provided laterally next to the panel element and is designed to uncover an elongated, vertically aligned ventilation opening in an open position.

According to yet another aspect, the invention relates to a fitting for a vertical sliding element. The fitting comprises a pair of guide rails which are intended to be mounted on an element frame. In addition, the fitting comprises a pair of support bars which have guide elements and by means of which the support bar is movably guided in the guide rail. Each of the support bars is provided with at least two parking scissors, via which a sash can be connected to the support bars. The parking scissors are designed for parallel parking of the sash from a closed position into a partially open position. Furthermore, the sash can be moved by the guide elements in a vertical moving direction into an open position in which the sash is provided at least in sections below the opening of the element frame that can be closed by the sash.

The term "inside" in the sense of the invention is used for areas of the façade element or the vertical sliding element which point in the direction of a building interior or for position or direction indications in order to designate a position directed into the building interior or a movement in this direction.

The term "outside" in the sense of the invention is used for areas of the façade element or the vertical sliding element pointing away from the building interior in the direction of an exterior area in front of the building or for position or direction indications in order to designate a position away from the building interior and towards this exterior area or a movement in this direction.

The term "profile system" in the sense of the invention refers in particular to a composite profile composed of a plurality of individual profile parts, for example an inner profile, an outer profile and an intermediate profile section or a section for thermal separation. These individual profile parts are joined together to form the composite profile. The composite profile can be used to assemble composite profile pieces to form a frame that accommodates a panel element.

The term "panel element" in the sense of the invention refers to a flat, especially planar element that is inserted into the façade element. The element can be e.g. a glass, especially an insulating glass or another filling, for example a non-transparent sandwich panel or the like.

The term "sash" in the sense of the invention refers to movable elements, in particular window sashes. In particular, these can be slidable to allow ventilation of a building. A sash can here be made of one part or several parts, i.e. it can comprise one or more sash parts.

"Guide element" in the sense of the invention refers to elements which are designed in such a way that they cooperate with a guide rail. "Guide element" can be understood in particular to mean a sliding carriage, a roller or a carriage-like element with several rollers. In particular, the guide element can be guided in a form-fit fashion in the guide rail.

"Guide element carrier" in the sense of the invention means supporting elements on which a guide element can be arranged. The guide element carrier here preferably forms a connecting element between a guide element and a support bar.

The terms "approximately", "substantially" or "about" in the sense of the invention refer to deviations from the respectively exact value by +/−10%, preferably by +/−5% and/or deviations in the form of changes insignificant for the function.

Developments, advantages and application possibilities of the invention also result from the following description of embodiments and from the drawings. All the features described and/or depicted are, in principle, the subject matter of the invention, either individually or in any combination, irrespective of their combination in the claims or their back-reference. The content of the claims is also made an integral part of the description.

BRIEF DESCRIPTION OF THE FIGURES

The invention is explained in more detail below on the basis of embodiments by means of the drawings, wherein.

DETAILED DESCRIPTION OF THE INVENTION

Figure 1:
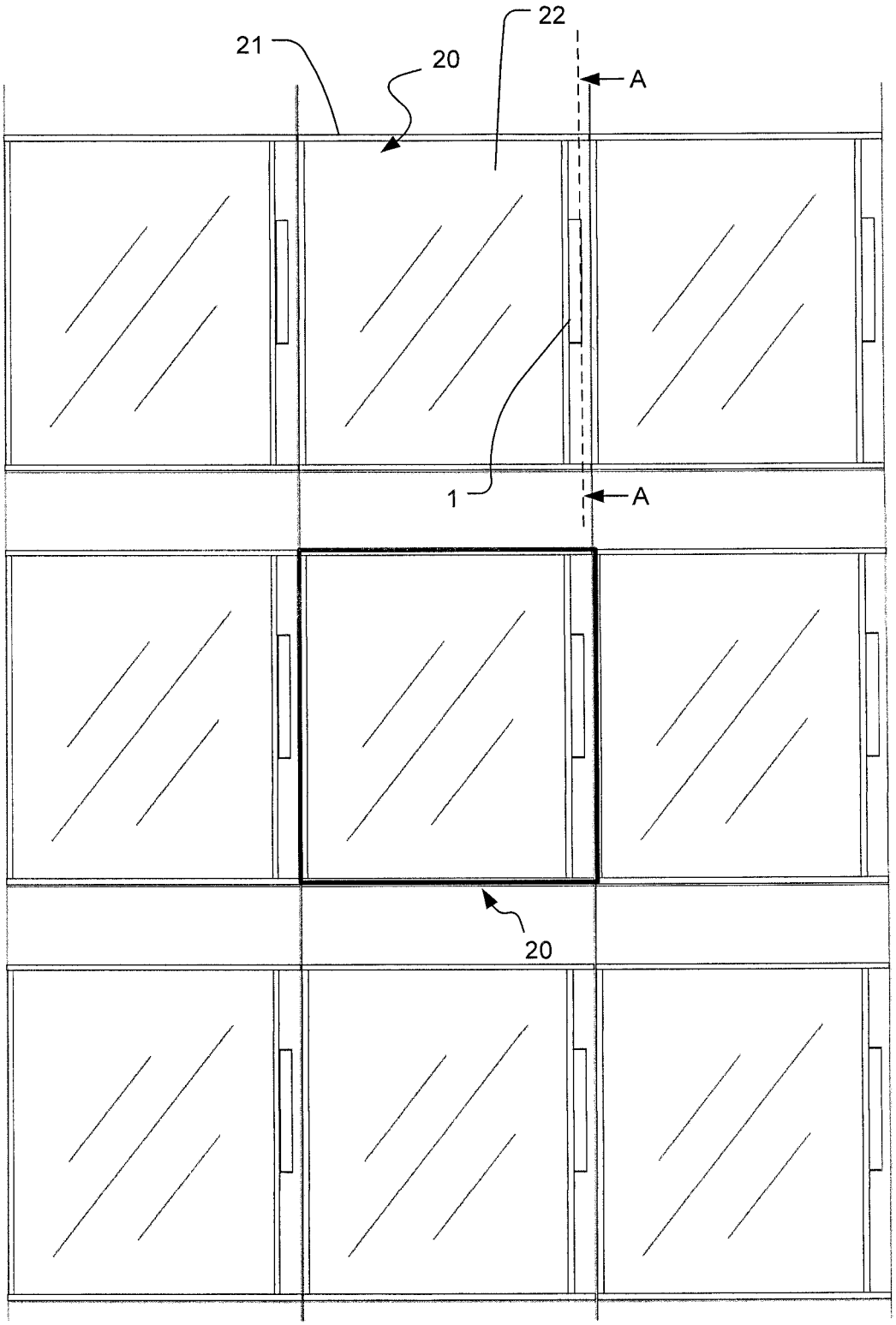
FIG. 1 shows, by way of example and diagram, an external view of a building façade section comprising a large number of façade elements arranged on top of one another and side by side.

FIG. 1 shows, by way of example and diagram, a section of an external façade of a building. The external façade has a large number of façade elements 20 which are arranged side by side and on top of one another, and which delimit a building interior to the outside. FIG. 1 graphically highlights, by way of example, such a façade element 20 by a border.

The façade elements 20 each comprise a façade element frame 21 and a panel element 22, which can be e.g. a fixed glazing. Alternatively, the panel element 22 can be part of a window sash that can be opened. In the embodiment shown, one vertical sliding element 1 each is provided to the side next to the panel element 22 of a façade element 20. The vertical sliding element 1 has an element frame 2 and a sash 3, which can be moved in a vertical direction relative to the element frame 2. The element frame 2 can be formed at least in sections by frame sections of the façade element frame 21. For example, the sash 3 can be provided between a standing profile section of the façade element frame 21 and a transom 23, which separates sash 3 from the panel element 22.

Figure 2A:
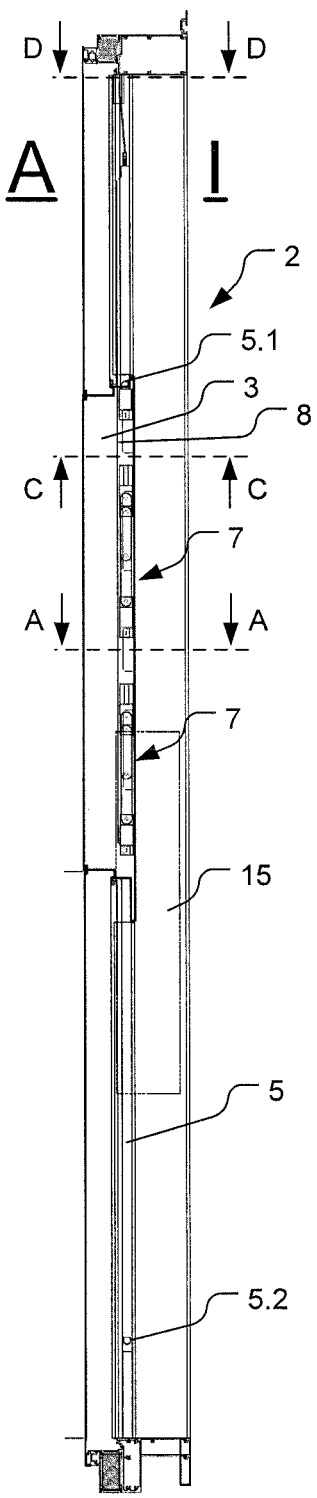
FIG. 2*a* shows, by way of example, a first embodiment of a vertical sliding element with closed sash in a vertical sectional view along the sectional line A-A according to FIG. 1.
Figure 2B:
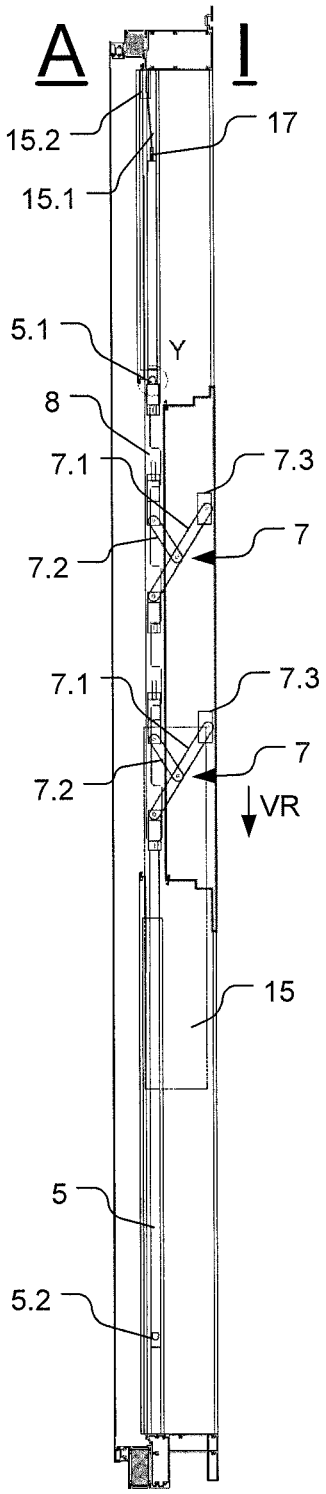
FIG. 2*b* shows, by way of example, a first embodiment of a vertical sliding element with parallel parked sash in a partially open position and in a vertical sectional view along the sectional line A-A according to FIG. 1.
Figure 2C:
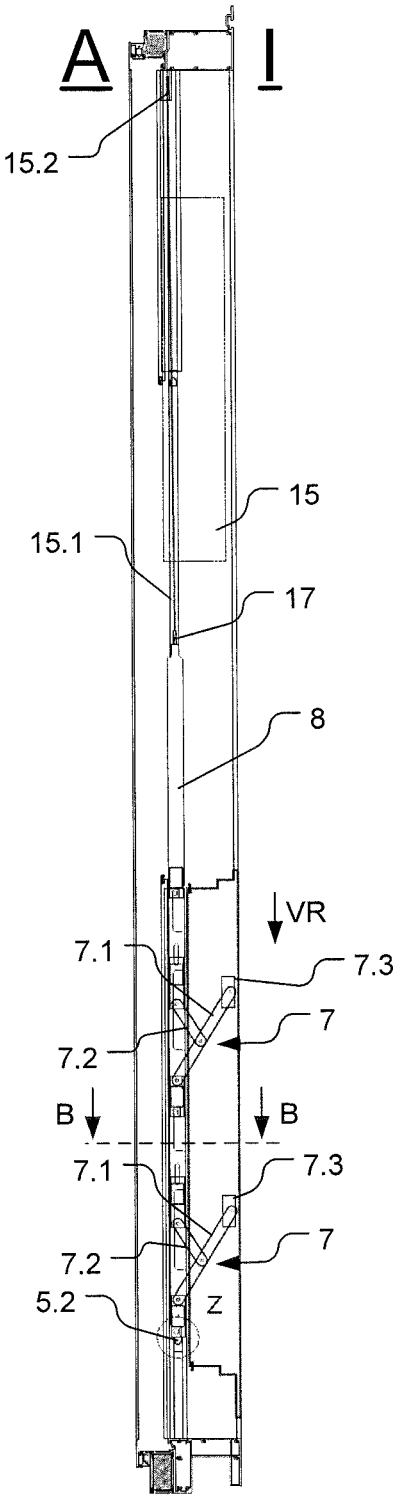
FIG. 2*c* shows, by way of example, a first embodiment of a vertical sliding element with sash in an open position and in a vertical sectional view along the sectional line A-A according to FIG. 1.

FIGS. 2*a* to 2*c* each show vertical sections through a façade element 20 in the area of the vertical sliding element 1, namely FIG. 2*a* shows a closed position, FIG. 2*b* a partially open position, in which the sash 3 is moved in front of the opening by parallel parking in the horizontal direction, without or substantially without a vertical movement component, and FIG. 2*c* an open position, in which the sash 3 of the vertical sliding element 1 is positioned in an open position by vertical displacement. In the following figures, area I refers to an interior area within the building and area A to an exterior area in front of the building.

The element frame 2 of vertical sliding element 1 has an opening which is closed in the closed position of sash 3 by the latter and is at least partially released in an open position or in a partially open position. In particular, the opening can be an elongated opening where the opening height is considerably greater than the opening width. For example, the opening height can be many times greater than the opening width, for example by a factor in the range from 3 to 10, in particular a factor between 7 and 9. For example, the opening width can be between 100 mm and 200 mm, whereas the opening height is between 800 mm and 1500 mm, in particular between 1000 mm and 1250 mm. Such opening sizes are used e.g. for façades of buildings that have an automatic ventilation system but also offer the possibility for people in the building to ventilate the interior naturally.

The façade element 20 is preferably designed as a flush-mounted façade element, i.e. in the closed position of the sash 3, the outside of the sash is flush with the outside of element frame 2.

The vertical sliding element 1 has an opening mechanism for opening the sash 3, which comprises a plurality of parking scissors 7. Using these parking scissors 7, the sash 3 can be positioned from the closed position (FIG. 2*a*) into a partially open position (FIG. 2*b*). This partial opening takes place in particular in such a way that the sash 3 is placed parallel in front of the opening of the element frame 2, i.e. the sash 3 is moved from the closed position parallel in the direction of the inner area I of the building by means of the parking scissors 7. In so doing, the orientation of the sash remains unchanged or substantially unchanged (i.e. the vertical axis of the sash is aligned vertically or substantially vertically).

After moving the sash 3 into the partially open position, it can then be moved into the open position shown in FIG. 2*c* by moving it vertically downwards (sliding direction VR). For this purpose, the sash 3 is movably guided, by means of guide rails 5 provided in the element frame 2, relative to this element frame 2. The guide rails 5 are mounted in particular on side faces 2.1, 2.2 of the element frame 2, preferably in such a way that in the closed position they are accommodated in a fitting chamber with their upper partial length. In the closed position of the sash 3, this fitting chamber is limited on the outside by the side faces 2.1, 2.2 of the element frame 2 and on the inside by the side faces 3.1, 3.2 of sash 3. In particular, a first guide rail 5 is provided between the side face 2.1 of element frame 2 and the side face 3.1 of the sash 3, and a second guide rail 5 is provided between the side face 2.2 of element frame 2 and the side face 3.2 of the sash 3, so that the sash 3 is guided on both sides in element frame 2.

The guide rails 5 each have a guide contour. For example, the guide rails 5 can have a C-shaped, or substantially C-shaped, cross-section. Other guide contours are also conceivable.

These guide rails 5 each contain guide elements in the form of sliding carriages 6, which are movably guided in the respective guide rails 5 in the sliding direction VR. Other types of guide elements are also conceivable. The sliding carriages 6 can preferably be mounted in a form-fit fashion in the respective guide rail 5. These sliding carriages 6 are connected at least indirectly to the parking scissors 7 and the latter, in turn, to the sash 3. This allows the sash 3 to be moved vertically by means of sliding carriages 6 guided in the guide rails 5, as shown in FIGS. 2*b* and 2*c*.

Stops 5.1, 5.2 are provided to limit the upward and downward sliding movement of the sash 3. For example, the upper stop 5.1 limits the upward sliding movement of the sash 3 and the lower stop 5.2 limits the downward sliding movement of the sash 3. The stops 5.1, 5.2 can be designed as rubber buffers, for example. These stops 5.1, 5.2 can in particular form limits for the sliding carriages 6, i.e. the upper sliding carriages 6 run on upper stops 5.1 and the lower sliding carriages 6 run on lower stops 5.2.

Figure 3:
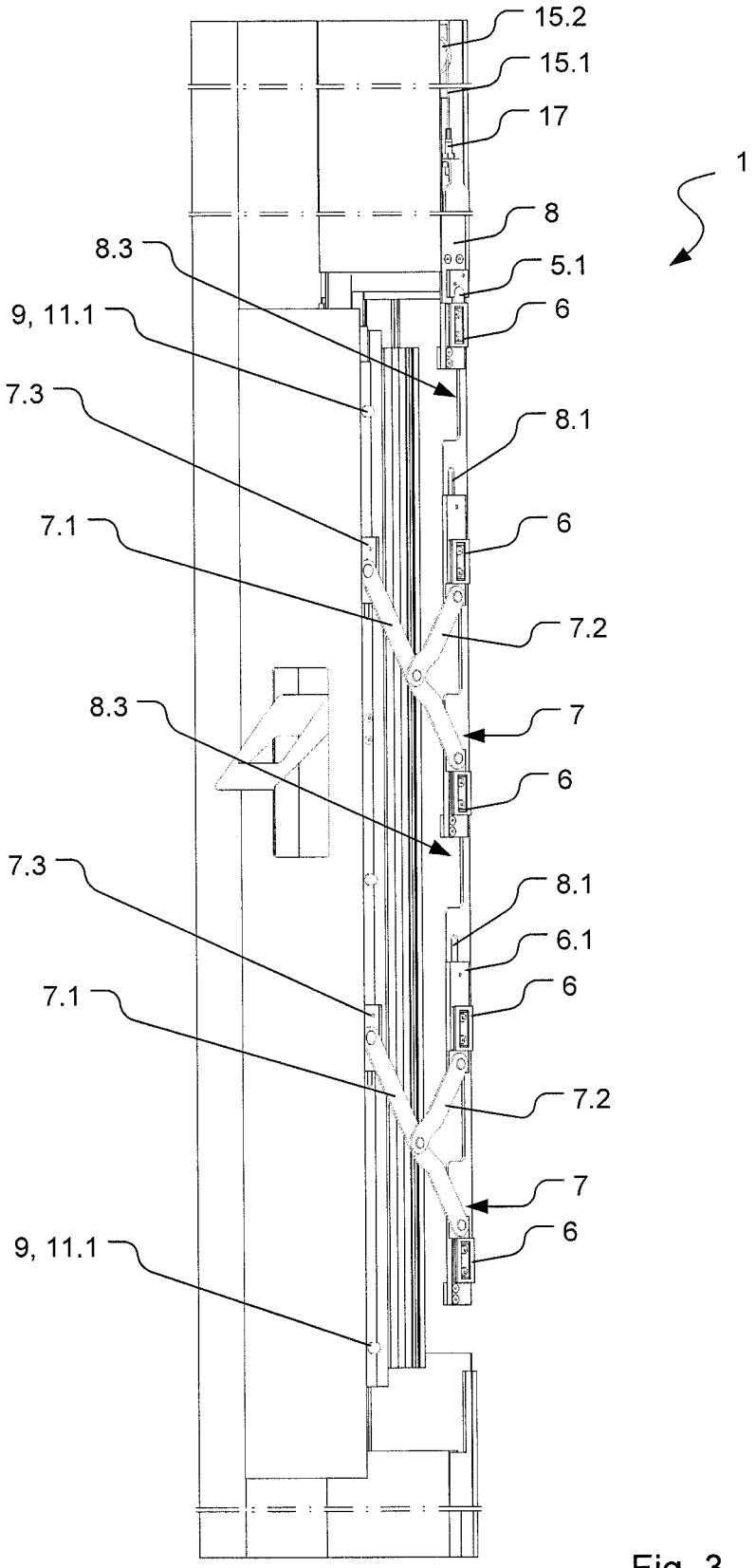
FIG. 3 shows, by way of example, a vertical sliding element in a perspective partial sectional view and in an oblique view from the inside of the building.

FIG. 3 shows the vertical sliding element 1 and its fittings in a greater degree of detail in a perspective sectional view.

The sliding carriages 6 are preferably provided on a support bar 8. The guide rails 5 provided on both opposite sides of the sash 3 are each assigned a support bar 8. The support bar 8 can be made of a flat material, for example. It extends preferably parallel or substantially parallel to the guide rail 5. The sliding carriages 6 are arranged either directly or indirectly on this support bar 8 via sliding carriage carriers 6.1. Therefore, the support bar 8 and the sliding carriages 6 provided on it are movably guided on the guide rail 5.

As can be seen in FIG. 3 in particular, the parking scissors 7 are articulated with the support bar 8, on the one hand, and with the sash 3, on the other hand.

The parking scissors 7 each comprise at least two scissors legs 7.1, 7.2, namely at least one long scissors leg 7.1 and one short scissors leg 7.2. The long scissors leg 7.1 is pivotally connected to the support bar 8 via a first free end and has a sash fastening element 7.3 at a second free end opposite the first free end, by means of which the long scissors leg 7.1 is connected to the sash 3. The long scissors leg 7.1 is pivotally connected to the sash fastening element 7.3.

The short scissors leg 7.2 is articulated at a first free end in a central area of the long scissors leg 7.1 to the latter, i.e. a hinge point connecting the scissors legs 7.1, 7.2 lies between the free ends of the long scissors leg 7.1. At a second free end, the short scissors leg 7.2 is connected at least indirectly pivotally and movably to the support bar 8. The movability of the short scissors leg 7.2 in relation to the support bar 8 can be achieved in particular by means of an elongated hole 8.1, which is provided in the support bar 8. The short scissors leg 7.2 can either engage directly in this elongated hole 8.1 by means of a pin-shaped connecting element or the short scissors leg 7.2 can be coupled with the support bar 8 via a sliding carriage carrier 6.1, as shown in FIG. 3. In particular, the sliding carriage carrier 6.1 can be movably guided in the elongated hole 8.1 of the support bar 8 and connected to the short scissors leg 7.2 via a bolt-shaped connecting member. This allows a space-saving arrangement of the parking scissors 7 in the fitting, in particular in the closed position of sash 3.

The arrangement of the scissors' legs 7.1, 7.2 of the parking scissors 7 can be such that they are received in the fitting chamber in the closed position with their longitudinal axis aligned vertically or substantially vertically. When moving the sash 3 to the partially open position shown in FIG. 3, the scissors legs 7.1, 7.2 are counter-pivotable in such a way that the long scissors leg 7.1 runs at an acute angle oblique to the vertical, this angle opening upwards, and the short scissors leg 7.2 runs at an acute angle oblique to the vertical, this angle opening downwards.

The scissors legs 7.1, 7.2 can be offset at least in sections to allow the legs 7.1, 7.2 to pivot into a pivoting position in which the scissors legs 7.1, 7.2 and the support bar 8 run parallel or substantially parallel.

Figure 4A:
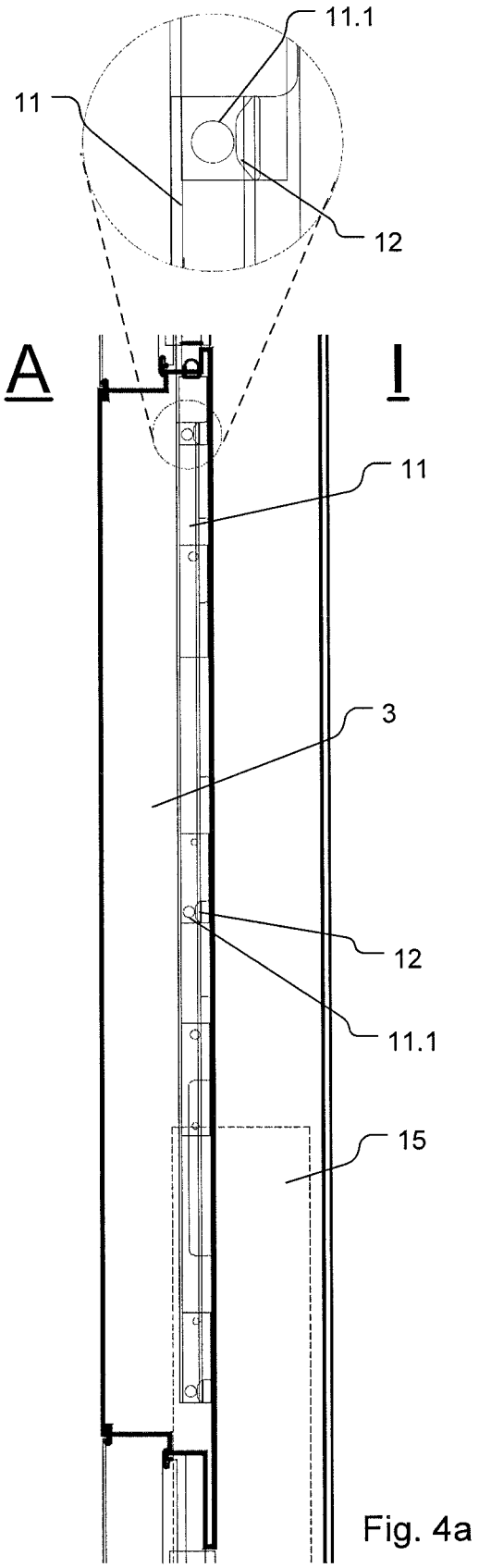
FIG. 4*a* shows, by way of example, a vertical sliding element with closed sash in the locked state in a vertical sectional view along the sectional line A-A according to FIG. 1.
Figure 4B:
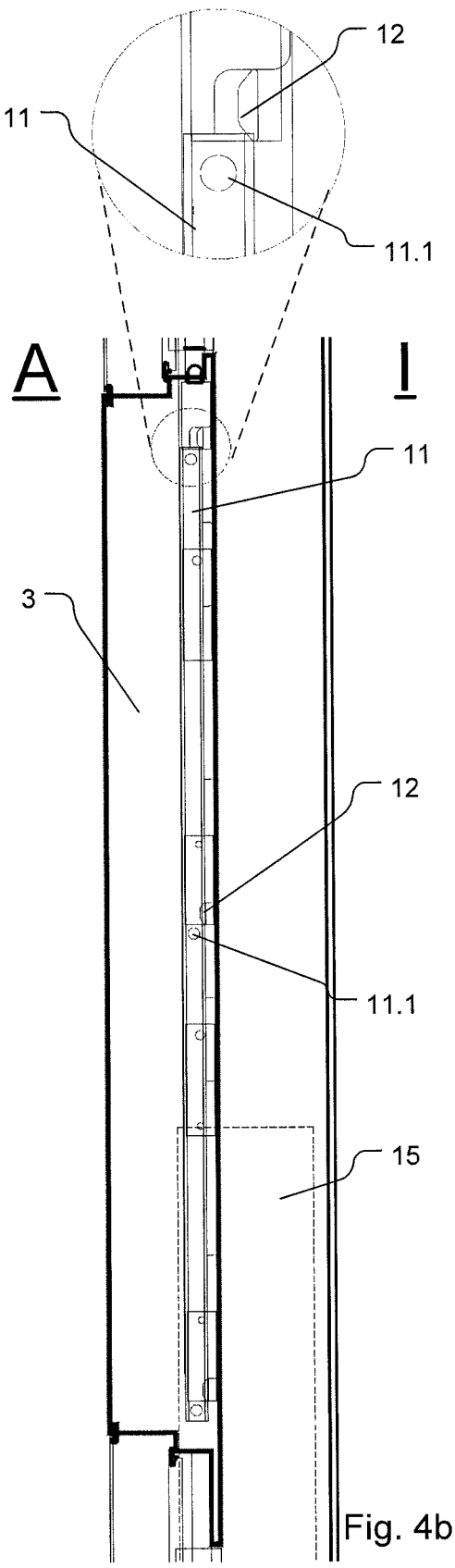
FIG. 4*b* shows, by way of example, a vertical sliding element with closed sash in the unlocked state in a vertical sectional view along the sectional line A-A according to FIG. 1.

FIGS. 4*a* and 4*b* show the locking mechanism by means of which the sash 3 is fixed in the closed position relative to element frame 2. The sash 3 is provided with sash-side locking members, which are formed, for example, by a driving rod 11 which is slidable in the vertical direction and on which locking bolts 11.1 are provided. The driving rod 11 can be moved in a known manner by an actuating element, for example by a rotatable or foldable handle element.

The locking blocks 12 cooperating with the locking bolts 11.1 are provided on the support bars 8 and are therefore also displaced with the support bars 8 when the sash 3 moves vertically. The sash 3 is therefore not locked directly opposite the locking blocks 12 provided on the element frame 2, but indirectly opposite this element frame 2, namely via the support bar 8, which, in turn, is movably held in the guide rails 5 provided on the element frame 2. In the closed position of the sash 3, the latter is thus secured against parallel parking via the locking members. The vertical sliding movement of the sash 3 is prevented by the positive engagement of the sash 3 in the opening provided on element frame 2 or the upper stop 5.1.

The locking bolts 11.1 are preferably designed as adjustable elements. They can be turned closer to or away from the locking blocks 12 via an eccentric pivot point. This allows the contact pressure generated by the lock to be varied as required.

Figure 5:
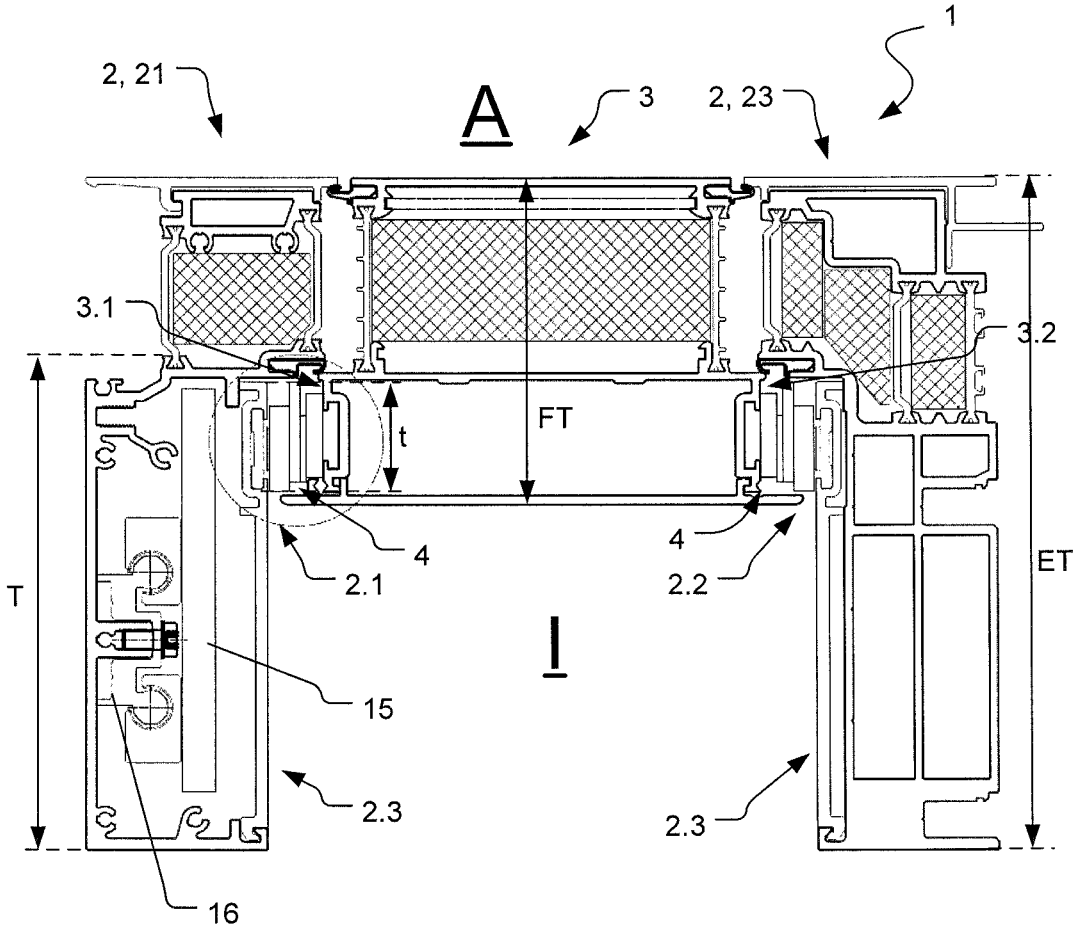
FIG. 5 shows, by way of example, a façade element comprising a vertical sliding element with closed sash in a horizontal sectional view along the sectional line A-A according to FIG. 2*a;*
Figure 6:
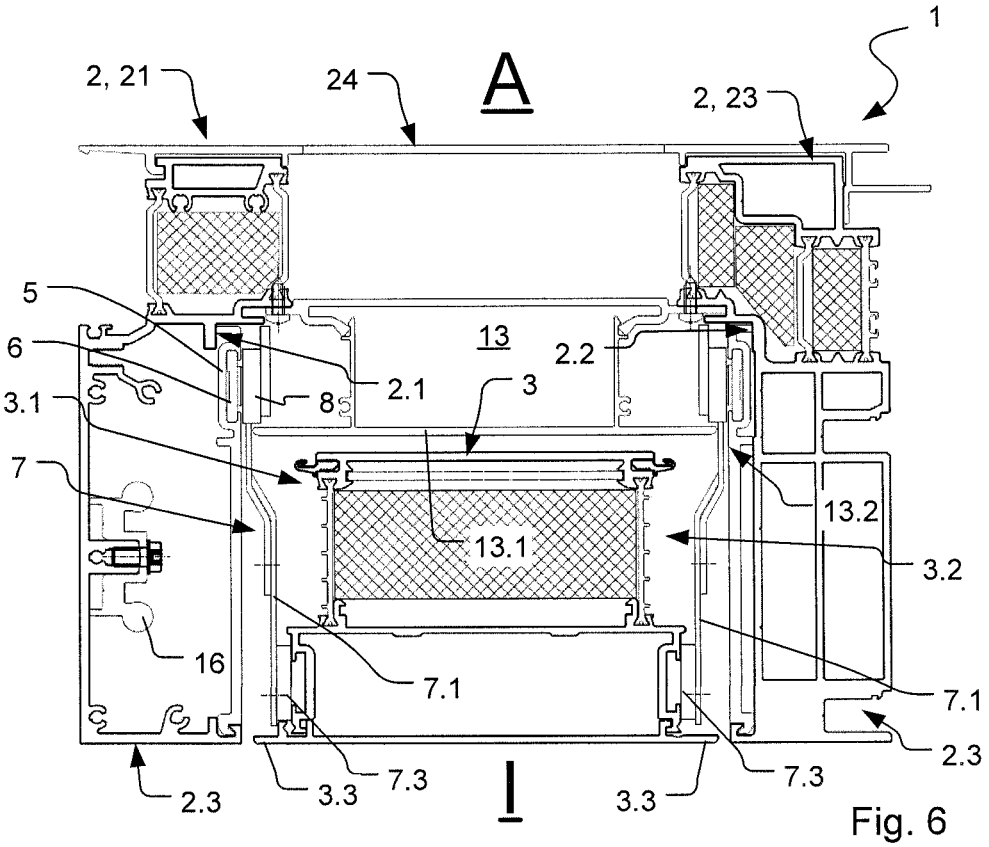
FIG. 6 shows, by way of example, a façade element comprising a vertical sliding element with open sash in a horizontal sectional view along the sectional line B-B according to FIG. 2*c;*
Figure 7:
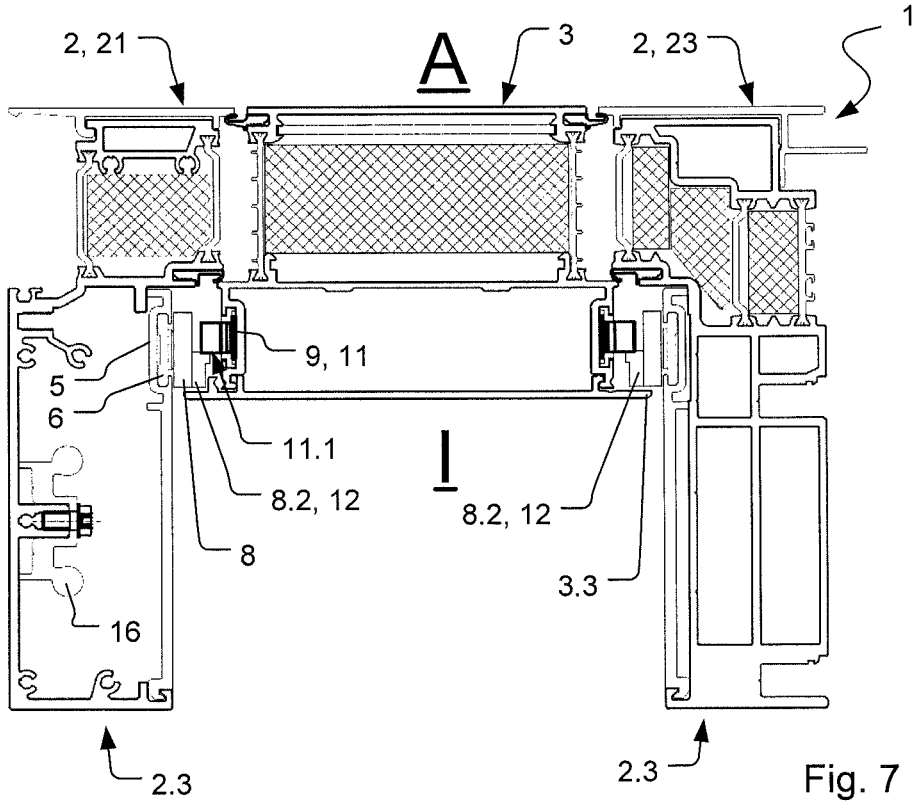
FIG. 7 shows, by way of example, a vertical sliding element with closed sash in the locked state in a horizontal sectional view along the sectional line C-C according to FIG. 2*a;*
Figure 8:
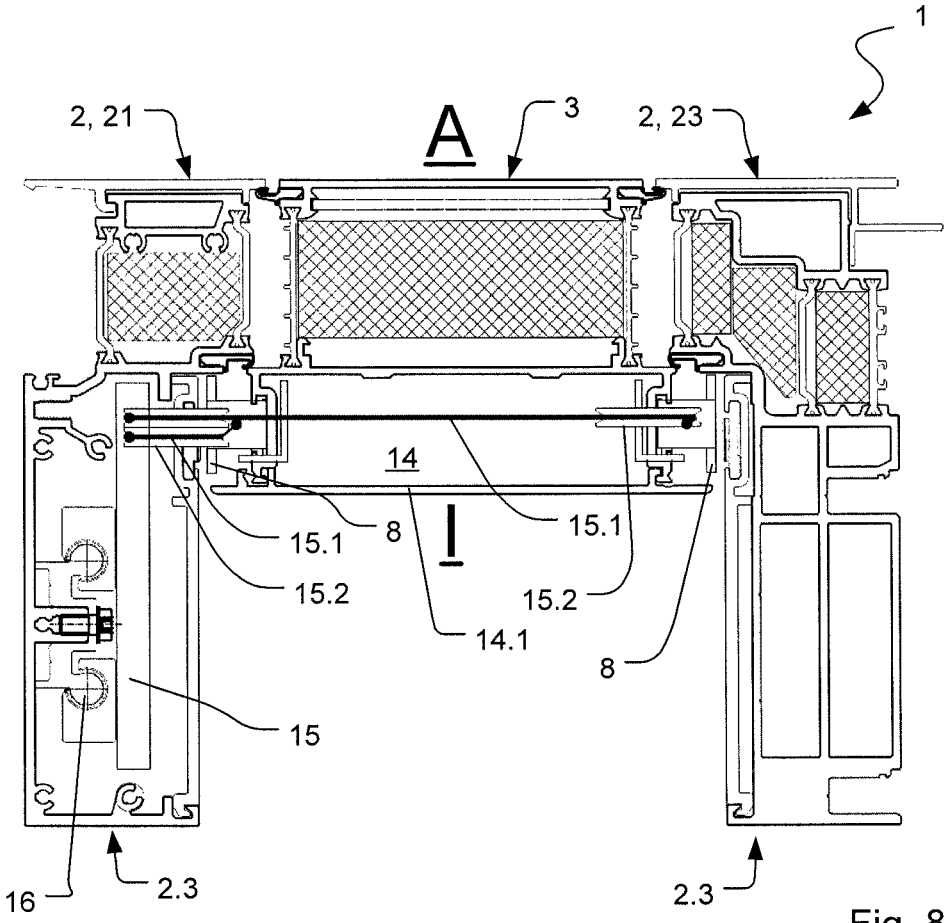
FIG. 8 shows, by way of example, a façade element comprising a vertical sliding element with closed sash and a pair of deflection rollers which helps to balance the weight in a horizontal sectional view along the sectional line D-D according to FIG. 2*a;*
Figure 9A:
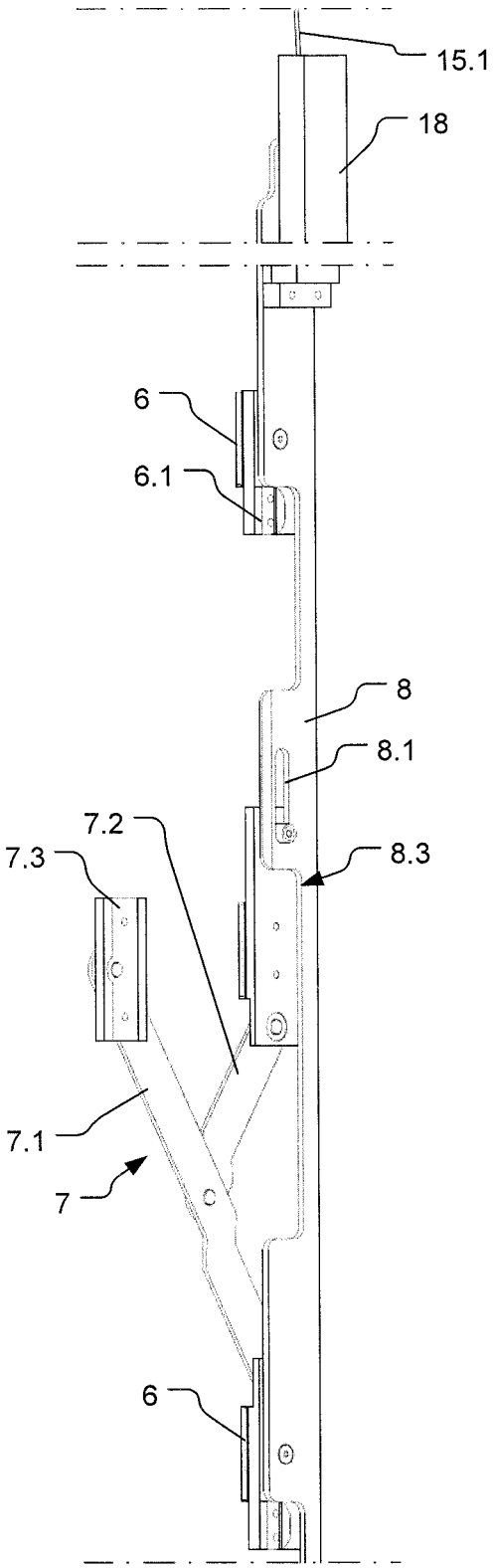
FIG. 9*a* shows, by way of example, a left-side fitting arranged on the sash for a vertical sliding element in the open position in perspective view from the sash side.
Figure 9B:
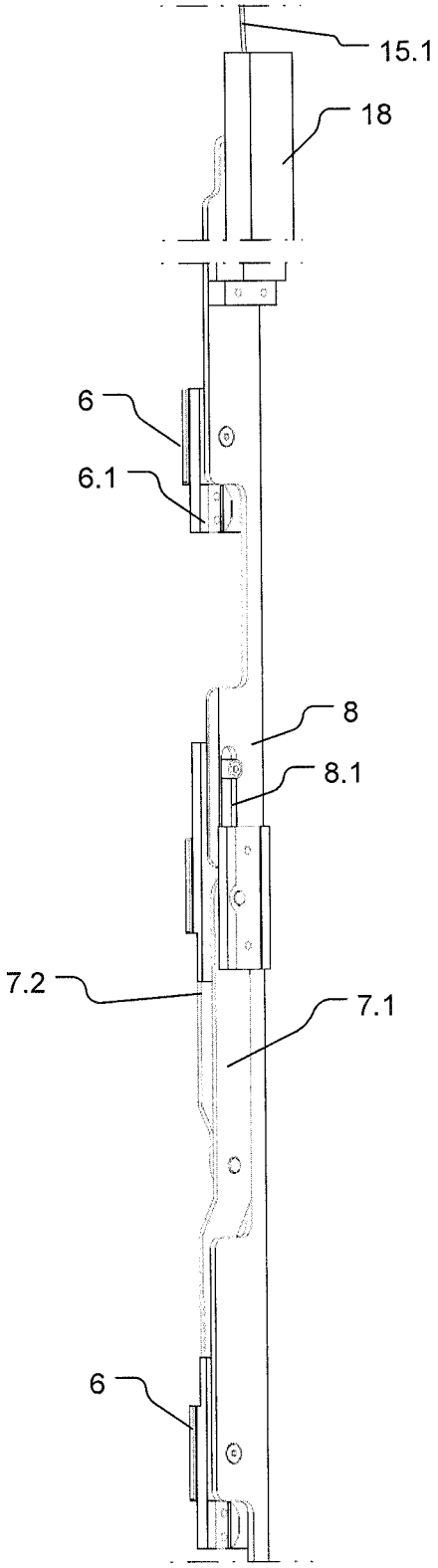
FIG. 9*b* shows, by way of example, a left-side fitting arranged on the sash for a vertical sliding element in the closed position in a perspective view from the sash side.

FIGS. 5 to 8 each show horizontal sectional views through a façade element 20, FIGS. 5, 7 and 8 showing the closed position and FIG. 6 the open position of the sash 3.

In the embodiment shown, the element frame 2 is arranged to the side next to a panel element 22 (not shown), for example a fixed glazing, and is formed at least in sections by the façade element frame 21. In order to separate the panel element 22 from the sash 3, a transom 23 is provided, which forms a further section of element frame 2. The element frame 2 or the façade element frame 21 is formed from composite profiles, in particular aluminum composite profiles, which consist of e.g. an inner and an outer profile, which are arranged spaced apart from one another by a thermal separation. The composite profiles have a profile depth T in the range between 170 mm and 250 mm, in particular 190 mm to 220 mm, most preferably 200 mm. In particular, the inner profile (profile section 2.3 protruding inwards from the thermal separation) of the composite profile has a profile depth in the range between 100 mm and 150 mm, in particular between 120 mm and 140 mm. Such a large profile depth T makes it possible for the sash 3 to be flush-mounted on the inside in the open position.

The fitting allowing the parking movement and vertical sliding movement of the sash 3 is formed, as previously mentioned, by a pair of guide rails 5 provided on opposite sides 2.1, 2.2 of element frame 2. These guide rails 5 are integrated in intermediate spaces 4, which, in the closed position of the sash 3, are formed between the side faces 2.1, 2.2 of element frame 2 and the opposite side faces 3.1, 3.2 of the sash 3. In other words, the side faces 2.1, 2.2 of the element frame 2 opposite at the same height in the closed position of the sash 3 and the side faces 3.1, 3.2 of the sash 3 define a fitting chamber into which the guide rails 5 are integrated.

The depth of the guide rails 5 is essentially equal to the depth of the fitting chamber which is spatially limited in the closed position. In particular, the depth t of the guide rails 5 is substantially smaller than the depth T of the profile section 2.3 projecting inwards from the thermal separation. As a result, in the closed position, the guide rails 5 can be received in the fitting chamber in such a way that they are invisible from the front.

Figure 5A:
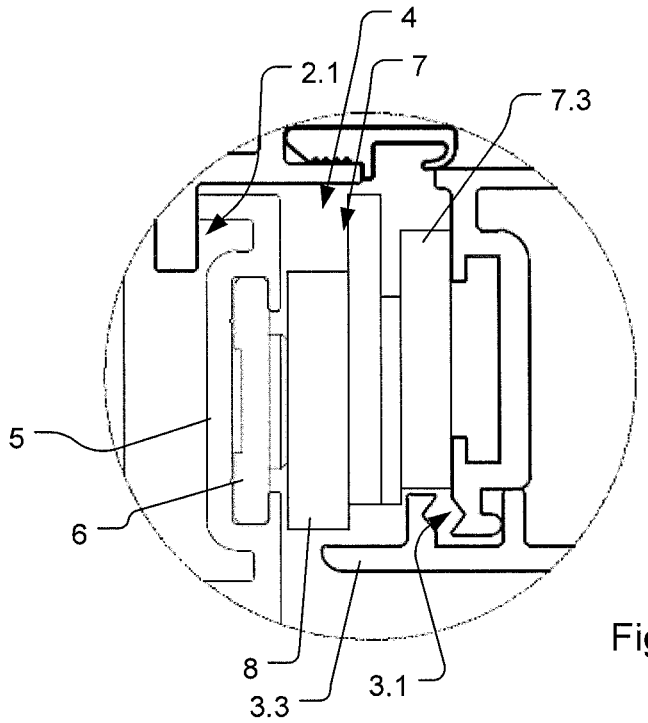
FIG. 5*a* shows, by way of example, a detailed view of the fitting in the left area of the vertical sliding element according to FIG. 5.

As can be seen in particular in FIGS. 5 and 5*a*, the parking scissors 7 are designed in such a way that, in the closed position of the sash 3, the scissors legs 7.1, 7.2, which are vertically aligned with their longitudinal axes between the guide rail 5 and the side faces 3.1, 3.2 of the sash 3, are accommodated in the fitting chamber.

As can be seen in particular in FIG. 6, the sash 3 has a sash depth FT, which is equal to or less than half the depth ET of element frame 2, in particular in the area of profile area 2.3 (FT≤ET/2). This means that, when closed, the sash 3 is flush-mounted on the outside or is substantially flush-mounted on the outside with element frame 2 and, when open, is flush-mounted on the inside with the inner side of element frame 2. In other words, the swing-out movement required to open the sash 3 takes place completely within the element frame 2, i.e. in the open state, the sash 3 does not project beyond the plane spanned by the inner sides of element frame 2.

In order to be able to optically cover the guide rails 5, sliding carriages 6 and swing-out scissors 7 in the closed position, the sash 2 has cover sections 3.3 on the inside. The cover sections 3.3 protrude laterally from the inside of the sash in a horizontal direction and thus at least partially close the intermediate space between the element frame 2 and the sash 3 (limited by the side faces 2.1, 2.2, 3.1, 3.2), in which the guide rails 5, sliding carriages 6 and swing-out scissors 7 are provided. Preferably, the cover sections 3.3 are dimensioned in such a way that a circumferential shadow groove, for example a shadow groove in the range of 2 to 6 mm, in particular 4 mm, results in the closed position. As can be seen e.g. in FIGS. 5 and 5*a*, an optically inconspicuous integration of the fitting parts is thus achieved.

FIG. 6 shows an example of a horizontal sectional view through a façade element 20 in an area below the opening that can be closed by the sash 3 and with a sash 3 in the open position. The element frame 2 is filled in this area by a façade element section 24. On the inside in front of the façade element section 24, a chamber 13 is formed, which is closed in the direction of the interior I by a cover 13.1. In particular, the cover 13.1 can be a removable cover. This makes it possible to remove the cover 13.1 when installing the window or during installation work in order to make the area below the opening that can be closed by the sash 3 in the closed position accessible.

Shadow grooves 13.2 are respectively provided between the cover 13.1 and the profile sections 2.3, through which the scissors legs 7.1, 7.2 can be passed. In particular, the scissors legs 7.1, 7.2 are positioned above the shadow grooves 13.2 when opening the sash 3, so that the scissors legs 7.1, 7.2 can be inserted into the shadow grooves 13.2 from above when vertically moving the sash 3.

By analogy with the chamber 13, a chamber 14 can also be provided above the opening closed by the sash 3 in the closed position, which can also be closed, for example, by a removable cover 14.1. This makes it possible to create a room accessible from the inside even above this opening, which can be used for maintenance and installation work, and also to accommodate other functional elements.

As previously mentioned, the vertical sliding element has a locking mechanism in which locking bolts 11.1 arranged on a driving rod 11 on the sash side cooperate with locking blocks 12 arranged on the support bars 8.

FIG. 7 shows a horizontal sectional view through a façade element 20 with a sash 3 in the closed position in an area in which the locking bolts 11.1 or locking blocks 12 are provided. When locking the sash 3, the locking bolts 11.1 engage behind the locking blocks 12 so that a parallel parking of the sash 3 is blocked.

As shown in FIGS. 2*a* to 2*c*, the sash 3 can be operatively connected to members via which a weight compensation of the sash 3 can be affected. In particular, the weight compensation can be used to decelerate the sash 3 during opening in order to prevent the sash 3 from accelerating excessively during the vertical downward sliding movement and hitting the stop 5.2 in an unintentionally strong fashion. Conversely, during closing, the weight compensation can be used to move the sash 3 upwards, supported by the weight compensation, so that a person operating the sash 3 does not have to lift the entire weight of the sash 3. In addition, as a result of the weight compensation the sash can be positioned in a desired sliding position, i.e. e.g. in a partially open position, without the sash 3 always continuing to move into the fully open position due to gravity. In other words, the weight compensation can form a weight element that compensates the gravitational force of the sash 3.

The weight compensation can be realized in different ways. For example, a counterweight 15 can be provided which is adapted to the weight of the sash 3, the counterweight 15 being selected to be in particular slightly lighter than the weight of the sash 3. The counterweight 15, for example, can be movably integrated in the frame profile of the element frame 2, in particular in the profile section 2.3. As shown in FIG. 8, the counterweight 15 is here coupled to the sash 3 via a connecting member 15.1, for example a rope, via at least one deflection roller 15.2. This means that, when the sash 3 is opened, the counterweight 15 is raised by a vertically downward sliding movement, counteracting the gravitational force acting on the sash 3 and then supporting the closing movement by lowering the counterweight 15 when closing the sash 3.

In order to prevent the counterweight 5 from falling without deceleration onto the floor of the element frame 2 when the connecting member 15.1 breaks off, a damping element, e.g. a damping element containing a spring, can be provided in the element frame 2, which in this case absorbs the impact of the counterweight 15. In order to be able to replace the damping element and/or to carry out maintenance work in the area of the damping element, the element frame 2 can have, in the area of the damping element, an inspection opening which can be closed e.g. by a cover.

In the embodiment shown, the counterweight 15 is movably guided on a guide element 16, which is provided inside the profile section 2.3. The guide element 16 can be in particular a guide rail. Maintenance-free plain bearings can preferably be provided between the counterweight 15 and the guide element 16, by means of which low-friction guidance of the counterweight 15 on the guide element 16 is achieved.

The connection members 15.1 preferably establish a connection between the counterweight 15 and a support bar 8. This ensures that the connecting members 15.1 are not deflected by the parallel parking of the sash 3 in the direction of the interior area I.

To ensure that the sash 3 is suspended as distortion-free as possible, each of the two support bars 8 is preferably coupled to the counterweight 15 via connecting means 15.1 and corresponding deflection rollers 15.2. Preferably, a connection member 15.1 on the top and closed by the cover 14.1 spans the narrow opening side formed in the element frame in order to be coupled to the support bar 8 located at a distance from the counterweight 15.

FIGS. 9*a*, 9*b* and 10*a*, 10*b* show the fittings used for the sliding and parallel parking movement of the sash 3, the guide rails 5 not being shown in the drawings for reasons of clarity.

In addition to the pair of guide rails 5 which can be attached to the element frame 2, the fitting of vertical sliding element 1 comprises a pair of support bars 8. The slide carriages 6 are preferably attached to the support bars 8 via sliding carriage carriers 6.1. Furthermore, the support bars 8 are each provided with a pair of parking scissors 7, which can be opened (FIG. 9*a*, FIG. 10*a*) or closed (FIG. 9*b*, FIG. 10*b*) for parallel parking of the sash 3.

As described above, the support bars have 8 elongated holes 8.1, which allow the opening and closing of the parking scissors 7. In the embodiment shown, a free end of the short scissors leg 7.2 is pivotally connected to the sliding carriage carrier 6.1. This sliding carriage carrier 6.1, in turn, is movably guided in the area of the free end opposite the short scissors leg 7.2 in the elongated hole 8.1. By moving the sliding carriage carrier 6.1 in the elongated hole 8.1, the position of the free end of the short scissors leg 7.2 is changed and the parking scissors 7 are thus opened or closed.

The support bar 8 has a recess 8.3 in the area in which the sliding carriage carrier 6.1 is provided. In this recess 8.3, the free end of the long scissors leg 7.1 can be accommodated in the closed position of the sash 3, namely an upper section of the long scissors leg 7.1, on which the sash fastening element 7.3 is provided.

In addition, the long scissors leg 7.1 can be offset so that in the closed position of the parking scissors 7 the upper section of the long scissors leg 7.1 lies in the plane spanned by the support bar 8. As can be seen in particular in FIG. 9*b*, this allows an extremely space-saving arrangement of the fitting in the fitting chamber.

Figure 10A:
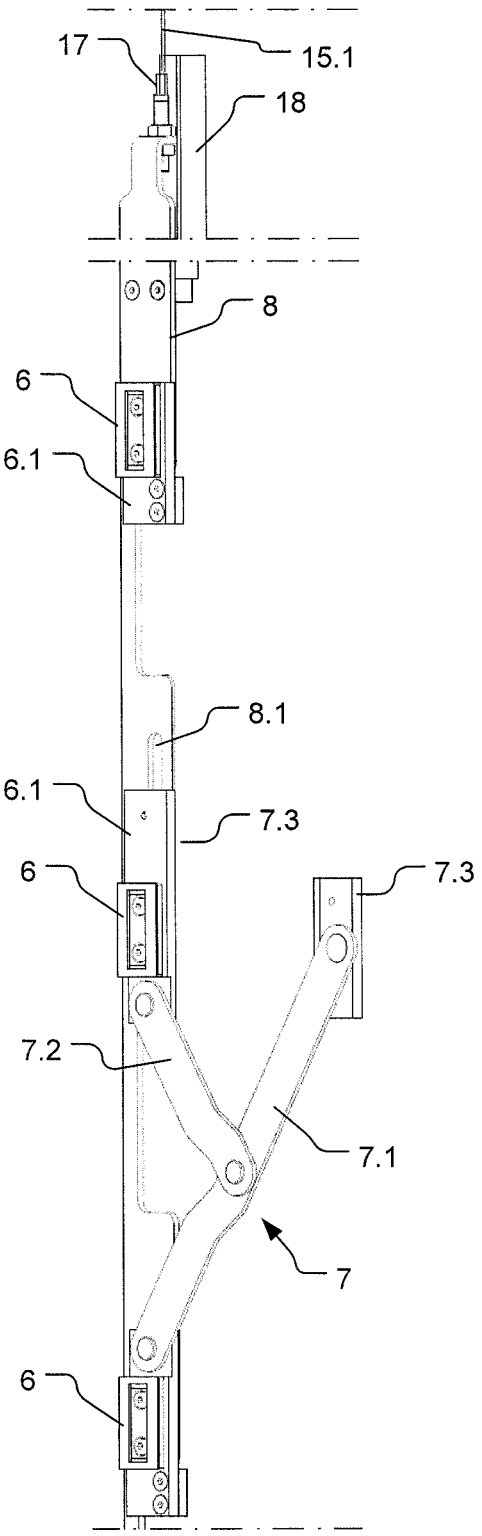
FIG. 10*a* shows, by way of example, a left-side fitting arranged on the sash for a vertical sliding element in the open state in a perspective view from the element frame side.
Figure 10B:
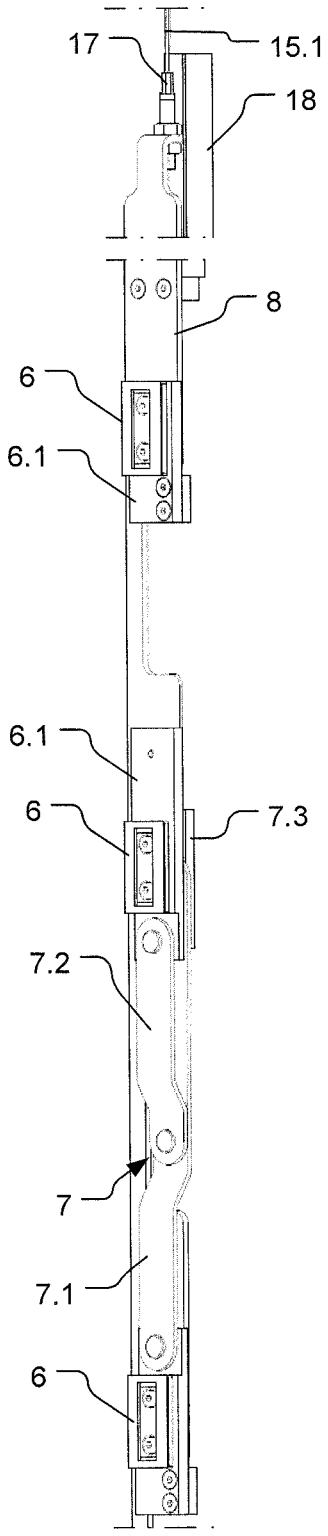
FIG. 10*b* shows, by way of example, a left-side fitting arranged on the sash for a vertical sliding element in the closed state in a perspective view from the element frame side.

As can be seen in particular in FIGS. 10*a* and 10*b*, the connecting members 15.1 are connected to the respective support bar 8 via coupling points 17 in the upper area of the support bars 8. In particular cable tensioners with a thread can be provided at the coupling points 17. The thread of the rope tensioners can be screwed into a thread provided on the support bar 8. This allows a length adjustment or adjustability of the weight compensation of the sash 3 to be achieved.

The support bars 8 and the parking scissors 7 can be made of metal, especially stainless steel.

The sliding carriages 6 can be made of a plastic material, in particular polytetrafluoroethylene, which, for example, has self-lubricating properties. This allows a lubricant-free plain bearing to be achieved between the guide rail 5 and the sliding carriages 6.

A cover element 18 is provided on each side of the sash 3 in the area of the connecting members 15.1. This cover element 18 projects upwards in a vertical direction and covers the connecting members 15.1 at least in the direction of interior area I, so that they are no longer visible from the interior area I. Preferably, the cover element 18 is designed as a U-profile, which is open towards the element frame 2. This allows the cover element 18 to be installed in a technically simple manner and surrounds the connecting members 15.1 on three sides so that it is completely covered.

The cover element 18 is preferably moved in a vertical direction with the sash 3 and/or the support bars 8.

Figure 11A:
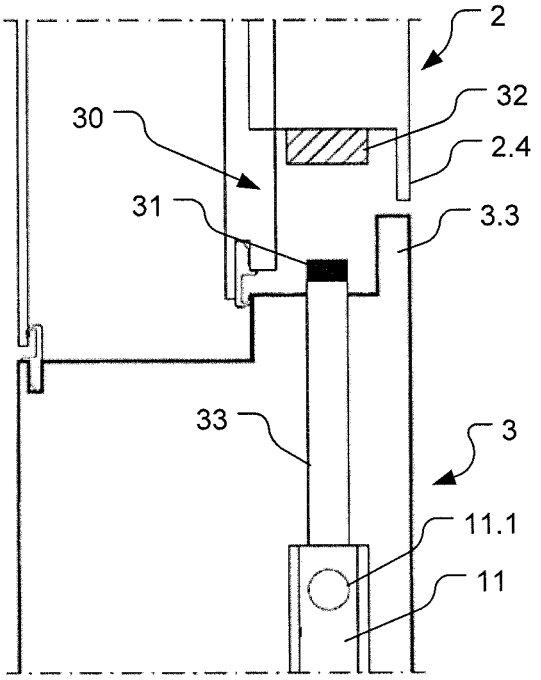
FIG. 11*a* shows, by way of example, a lateral sectional view of the sash and the element frame in an unlocked position and with a sensor system for detecting the locking state.
Figure 11B:
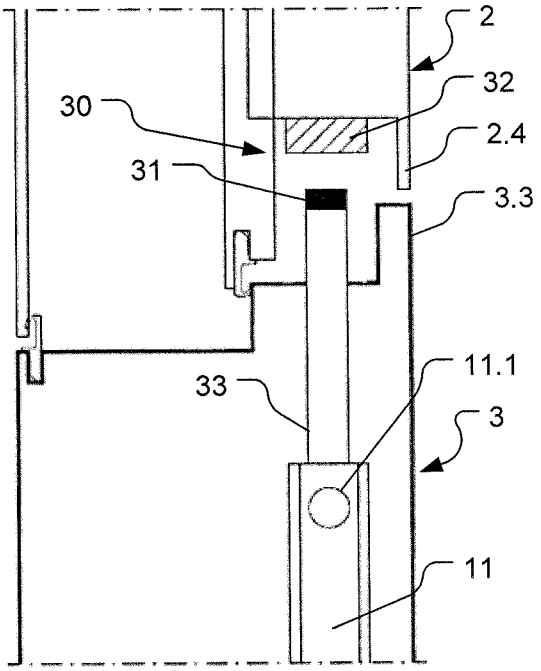
FIG. 11*b* shows, by way of example, a lateral sectional view of the sash and the element frame in a locked position and with a sensor system for detecting the locking state.
Figure 12:
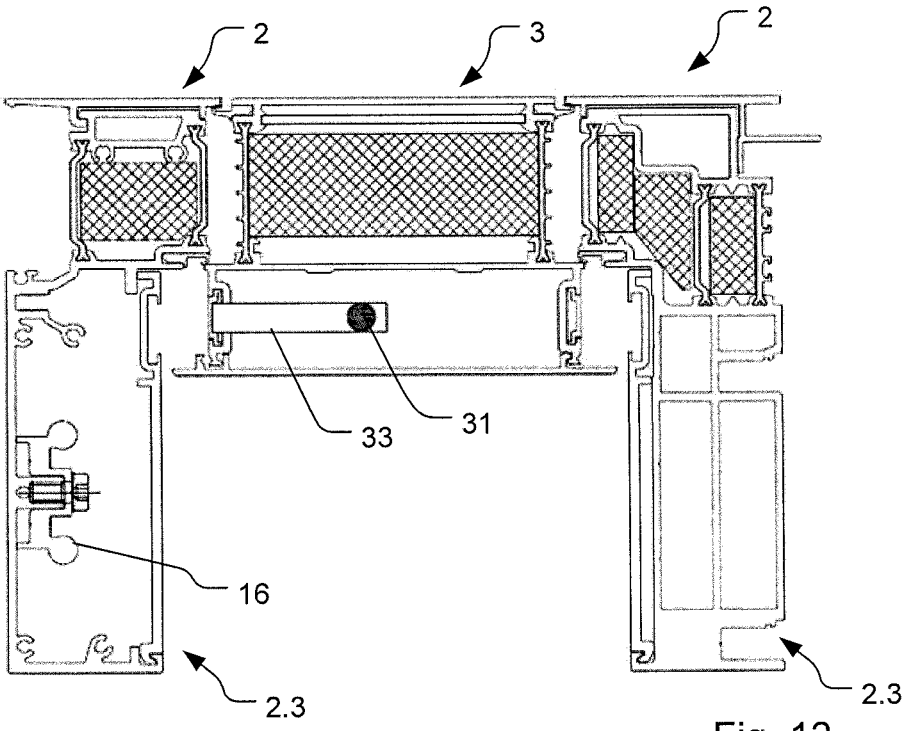
FIG. 12 shows, by way of example, a top side view of the vertical sliding element with an angled element for holding a first sensor system part.

FIGS. 11*a*, 11*b* and 12 show a sensor system 30, which is intended for checking the closing state of the vertical sliding element 1. The sensor system 30 comprises at least a first sensor system part 31 and at least a second sensor system part 32. The sensor system 30 can in particular be a magnetic sensor system, i.e. a sensor system which can check the closing state of the vertical sliding element 1 on the basis of a measurement or detection of a magnetic field. One of the sensor system parts 31, 32 can be formed by a magnet, in particular a permanent magnet, and the other sensor system part can be formed by a sensor that detects a magnetic field. In particular, this sensor can be designed to provide information as to whether or how close the magnet is to the sensor. In the embodiment shown, the first sensor system part 31 comprises the magnet and the second sensor system part 31 includes the sensor.

Preferably the first sensor system part 31 is provided on the sash 3 of the vertical sliding element 1 and the second sensor system part 32 is provided on the element frame 2. In the embodiment shown, the sensor system 30 is provided in an upper chamber between the sash 3 and an upper, horizontal profile section of element frame 2, namely in such a way that it is concealed behind the cover section 3.3 of the sash 3 or a cover section 2.4 of element frame 2 (FIGS. 11*a* and 11*b*). This allows an optically inconspicuous integration of the sensor system 30 into the vertical sliding element 1. It goes without saying that other arrangement options are also conceivable in principle.

The sensor system 30 is preferably designed or arranged in such a way that the closed position is only detected when not only the sash 3 is in the closed position, but the sash 3 is also locked. For this purpose, e.g. a sensor system part 31, 32, in the embodiment shown the first sensor system part 31, is coupled to the driving rod 11. This coupling is realized in the embodiment shown by means of an angle element 33. Other coupling members are also conceivable in principle. This allows the first sensor system part 31 to be positioned in the upper chamber between the sash 3 and the upper, horizontal profile section of element frame 2 and simultaneously coupled to the moving driving rod 11.

FIG. 11*a* shows the arrangement of the two sensor system parts 31, 32, relative to each other, in the closed position of the sash 3 in the unlocked state. FIG. 11*b*, on the other hand, shows the arrangement of the two sensor system parts 31, 32, relative to each other, in the closed position of the sash 3 in the locked state.

If the unlocked sash 3 moves into the closed position, the distance between the two sensor system parts 31, 32 is so large that either no signal is emitted at all by the sensor system 30 or the signal is characteristic of the unlocked state. If the sash 3 is locked, the driving rod 11 with the sensor system part 31 attached to it is moved upwards. This reduces the distance between the first sensor system part 31 and the second sensor system part 32 in such a way that a signal indicating the locking of the sash 3 is emitted.

Preferably, the sensor system 30 is coupled with a building-side interlocking monitoring device. This device can, for example, be centrally located in the building, on each floor or divided into other sectional arrangements. As a result, central and complete interlock monitoring of a large number of sashes 3 can be achieved via the sensor systems 30 provided on the vertical sliding elements 1.

The invention was described in the foregoing embodiments. It shall be understood that numerous changes and modifications are possible without abandoning the inventive concept on which the invention is based.

LIST OF REFERENCE SIGNS

1 sliding element
2 element frame

2.1 side face
2.2 side face
2.3 profile section
2.4 cover section
3 sash
3.1 side face
3.2 side face
3.3 cover section
4 intermediate space
5 guide rail
5.1 stop
5.2 stop
6 sliding carriage
6.1 sliding carriage carrier
7 parking scissors
7.1 long scissors leg
7.2 short scissors leg
7.3 sash fastening element
8 support bar
8.1 elongated hole
8.2 locking member
8.3 recess
9 sash-side locking member
11 driving rod
11.1 locking bolt
12 locking block
13 chamber
13.1 cover
13.2 shadow groove
14 chamber
14.1 cover
15 counterweight
15.1 connecting member
15.2 deflection roller
16 guide element
17 coupling point
18 cover element
20 façade element
21 façade element frame
22 panel element
23 transom
24 façade element section
30 sensor system
31 first sensor system part
32 second sensor system part
33 angle element
A exterior area
I interior area
t guide rail depth
T profile section depth
FT sash depth
ET element frame depth
VR moving direction

What is claimed is:

1. A vertical sliding element comprising:

an element frame and a sash movable in a vertical direction relative to the element frame, wherein, in a closed position of the sash, a fitting chamber is formed in each of a plurality of intermediate spaces which are laterally limited by mutually facing side faces of the sash and the element frame, the fitting chamber having guide rails and guide elements, the guide elements being formed by sliding carriages, guided in the guide rails, wherein the sash is connected to the sliding carriages via a scissors arrangement composed of a plurality of parking scissors, wherein the scissors arrangement is for parallel parking of the sash in a partially open position, in which the sash is positioned in front of an opening in the element frame, and wherein the sliding carriages move the sash parked in parallel in a vertical direction by moving the sliding carriages in the guide rails and wherein the sash is connected to the guide rails via a pair of support bars and the pair of support bars are held movably in the guide rails by the sliding carriages, and wherein the pair of support bars are slidingly guided by the sliding carriages, and the pair of support bars that are slidingly guided by the sliding carriages are mounted in a form-fit fashion in respective guide rails.

2. The vertical sliding element according to claim 1, wherein at least two elongated holes are in each of the support bars, the at least two elongated holes cooperating with the plurality of parking scissors and serving to affect the parallel parking of the sash.

3. The vertical sliding element according to claim 1, wherein the plurality of parking scissors includes two parking scissors on each of opposite vertical sash sides.

4. The vertical sliding element according to claim 1, wherein each of the plurality of parking scissors have a longer scissors leg and a shorter scissors leg.

5. The vertical sliding element according to claim 4, wherein the shorter scissors leg is articulated via a first free end on the longer scissors leg and is connected to the guide rail via a second free end in an articulated and movable fashion.

6. The vertical sliding element according to claim 5, wherein the first free end of the shorter scissors leg is guided on the support bar in an at least indirectly movable fashion.

7. The vertical sliding element according to claim 5, wherein the first free end of the shorter scissors leg is connected to the support bar via a guide element carrier, the guide element carrier is guided movably on the support bar.

8. The vertical sliding element according to claim 1, wherein locking members provided on a sash side cooperate with locking members provided on the support bars.

9. The vertical sliding element according claim 1, wherein the sash has laterally projecting cover sections, by which the fitting chamber is at least partially covered.

10. The vertical sliding element according to claim 1, wherein a weight compensation is provided.

11. The vertical sliding element according to claim 10, wherein a counterweight acting as the weight compensation is connected to the pair of support bars provided on opposite sides of the sash via connecting members.

12. The vertical sliding element according to claim 1, wherein, in a closed position, the sash is substantially flush-mounted on an outside with the element frame or, in an open position, the sash is substantially flush-mounted on an inside with the element frame or the element frame has a depth greater than twice a sash depth.

13. The vertical sliding element according to claim 1, wherein a sensor is provided for monitoring a locking state.

14. A fitting for a vertical sliding element comprising:

a pair of guide rails provided for arrangement on an element frame; and a pair support bars each having a plurality of guide elements, the guide elements being formed by sliding carriages, by which the pair of support bars are guided movably in the pair of guide rails, wherein each of the pair of support bars are provided with at least two parking scissors, via which a sash can be connected to the pair of support bars, wherein the at least two parking scissors are for parallel parking of the sash from a closed position into a partially open position, and wherein the pair of support bars are slidingly guided by the sliding carriages and the pair of support bars that are slidingly guided by the sliding carriages are mounted in a form-fit fashion in respective guide rails.

* * * * *